US005281965A

United States Patent [19]

Hoekman et al.

[11] Patent Number: 5,281,965

[45] Date of Patent: Jan. 25, 1994

[54] VEHICLE DETECTOR MEASUREMENT FRAME SEGMENTATION

[75] Inventors: Earl B. Hoekman, Roseville; Samuel Bernard, Jr., Vadnais Heights, both of Minn.

[73] Assignee: Minnesota Mining and Manufacturing Company, St. Paul, Minn.

[21] Appl. No.: 716,082

[22] Filed: Jun. 17, 1991

[51] Int. Cl.[5] ..... G08G 1/01

[52] U.S. Cl. ..... 340/941

[58] Field of Search ..... 340/941, 939, 938, 933

[56] References Cited

U.S. PATENT DOCUMENTS

| | | | |
|---|---|---|---|
| 3,943,339 | 3/1976 | Koerner et al. | 377/9 |
| 3,989,932 | 11/1976 | Koerner | 340/938 |
| 4,131,848 | 12/1978 | Battle | 340/941 |
| 4,491,841 | 1/1985 | Clark | 340/939 |
| 4,568,937 | 2/1986 | Clark | 340/939 |
| 4,668,951 | 5/1987 | Duley et al. | 340/941 |
| 4,680,717 | 7/1987 | Martin | 340/441 |
| 4,862,162 | 8/1989 | Duley | 340/938 |

*Primary Examiner*—Jin F. Ng
*Assistant Examiner*—P. W. Lee
*Attorney, Agent, or Firm*—Gary L. Griswold; Walter N. Kirn; William B. Barte

[57] ABSTRACT

A vehicle detector includes one or more inductive sensors connected to an oscillator circuit. A timing circuit defines a plurality of sequential measurement frame segments. The oscillator circuit is coupled to an inductive sensor during each of the measurement frame segments. The time duration of each of the plurality of measurement frame segments is measured. After the completion of each frame segment for a particular inductive sensor, a total measurement frame time duration for that sensor is calculated based upon durations of a predetermined number of measurement frame segments for that sensor. The total measurement frame time duration and a reference time duration are compared and a difference is determined. If the difference between the total measurement frame time duration and the reference time duration exceeds a threshold value, an output signal indicative of the presence of a vehicle in the vicinity of the inductive sensor is generated.

10 Claims, 3 Drawing Sheets

M = 4
SENSOR 12A = SA
SENSOR 12B = SB
SENSOR 12C = SC
SENSOR 12D = SD $T_{SEG\ ij}$ = $j^{th}$ period count segment for $i^{th}$ sensor.

$$T_{FRAME\ A} = T_{segA1} + T_{segA2} + T_{segA3} + T_{segA4}$$

$$T_{FRAME\ B} = T_{segB1} + T_{segB2} + T_{segB3} + T_{segB4}$$

$$T_{FRAME\ C} = T_{segC1} + T_{segC2} + T_{segC3} + T_{segC4}$$

$$T_{FRAME\ D} = T_{segD1}\quad T_{segD2}\quad T_{segD3}\quad T_{segD4}$$

VEHICLE DETECTOR MEASUREMENT FRAME SEGMENTATION

BACKGROUND OF THE INVENTION

The present invention relates to vehicle detectors which detect the passage or presence of a vehicle over a defined area of a roadway. In particular, the present invention relates to measurement frame segmentation in vehicle detectors as a means for shortening the detector output response time while maintaining detector sensitivity sufficient to detect small changes in inductance of the connected inductive sensor.

Inductive sensors are used for a wide variety of detection systems. For example, inductive sensors are used in systems which detect the presence of conductive or ferromagnetic articles within a specified area. Vehicle detectors are a common type of detection systems in which inductive sensors are used.

Vehicle detectors are used in traffic control systems to provide input data required by a controller to control signal lights. Vehicle detectors are connected to one or more inductive sensors and operate on the principle of an inductance change caused by the movement of a vehicle in the vicinity of the inductive sensor. The inductive sensor can take a number of different forms, but commonly is a wire loop which is buried in the roadway and which acts as an inductor.

The vehicle detector generally includes circuitry which operates in conjunction with the inductive sensor to measure changes in inductance and to provide output signals as a function of those inductance changes. The vehicle detector includes an oscillator circuit which produces a oscillator output signal having a frequency which is dependent on sensor inductance. The sensor inductance is in turn dependent on whether the inductive sensor is loaded by the presence of a vehicle. The sensor is driven as a part of a resonant circuit of the oscillator. The vehicle detector measures changes in inductance in the sensor by monitoring the frequency of the oscillator output signal.

Examples of vehicle detectors are shown, for example, in U.S. Pat. No. 3,943,339 (Koerner et al.) and in U.S. Pat. No. 3,989,932 (Koerner).

The duration of a measurement period required to detect a specific change in inductance is quite long when a small (e.g., 16 nanohenries) inductance change caused by a motorcycle or bicycle must be ascertained. Detection of automobiles, which cause larger inductance changes (e.g., greater than 3000 nanohenries on an inductive sensor in the form of a 3 turn, 6'×6' loop), may be accomplished with shorter measurement periods. In a detector that sequentially activates several inductive sensors, the response time of the detector to the presence of a vehicle over any one inductive sensor is determined by the summation of the time spent measuring the frequency of each of the inductive sensors. This becomes very important when vehicle speed is being measured. As the time spent measuring each inductive sensor increases, the ability to accurately estimate vehicle speed decreases. The ideal situation for speed measurement would be to spend a small amount of time measuring each inductive sensor regardless of the magnitude of the threshold change in inductance that is being measured.

In the past, vehicle detectors have typically utilized long measurement periods in order to ensure detection of small inductance changes. Prior art vehicle detectors are capable of measuring a wide range of inductance changes, but they are not capable of measuring small inductance changes while simultaneously utilizing short measurement periods. This is significant because the ability of the inductive sensor to measure vehicle speeds is a function of the measurement period length.

SUMMARY OF THE INVENTION

The present invention is directed to an improved vehicle detector and detection method which uses measurement frame segmentation to hold the detector response time down for larger vehicles while still allowing detection of a wide range of inductance changes. The measurement period necessary to detect small inductance changes is divided into a plurality of measurement frame segments, with each measurement frame segment being defined by a first number ($N_{seg}$) of cycles of the oscillator circuit signal, where $N_{seg}$ is an integer.

In preferred embodiments of the present invention, a timing circuit measures the time duration of each measurement frame segment. At the end of each frame segment, the oscillator circuit is coupled to a different inductive sensor. Also, after the completion of each frame segment, a total measurement frame time duration representative of time durations of a predetermined number (M) of measurement frame segments is produced. The total measurement frame time duration is compared to a reference time duration and a difference is calculated. A threshold circuit, responsive to the difference generates a signal indicative of the presence of a vehicle in the vicinity of the inductive sensor.

Because a detection decision is made after each segment of the total measurement frame, shorter response times are achieved without sacrificing detector sensitivity to small inductance changes. Small inductance changes are still detected because the plurality of measurement frame segments needed to make such a detection will at some point be represented by the total measurement frame time duration.

In preferred embodiments, measurement of the time duration of each frame segment is performed using a period counter driven by a different, unrelated clock oscillator from the oscillator used to control initiation of frame segments. This provides, when the inductive sensor oscillator is stopped and restarted between successive measurement frames, a randomization which prevents digitization noise from having a cumulative effect when multiple frame segment time durations are used to calculate a total measurement frame time duration.

DETAILED DESCRIPTION OF THE PREFERRED EMBODIMENTS

Figure 1:
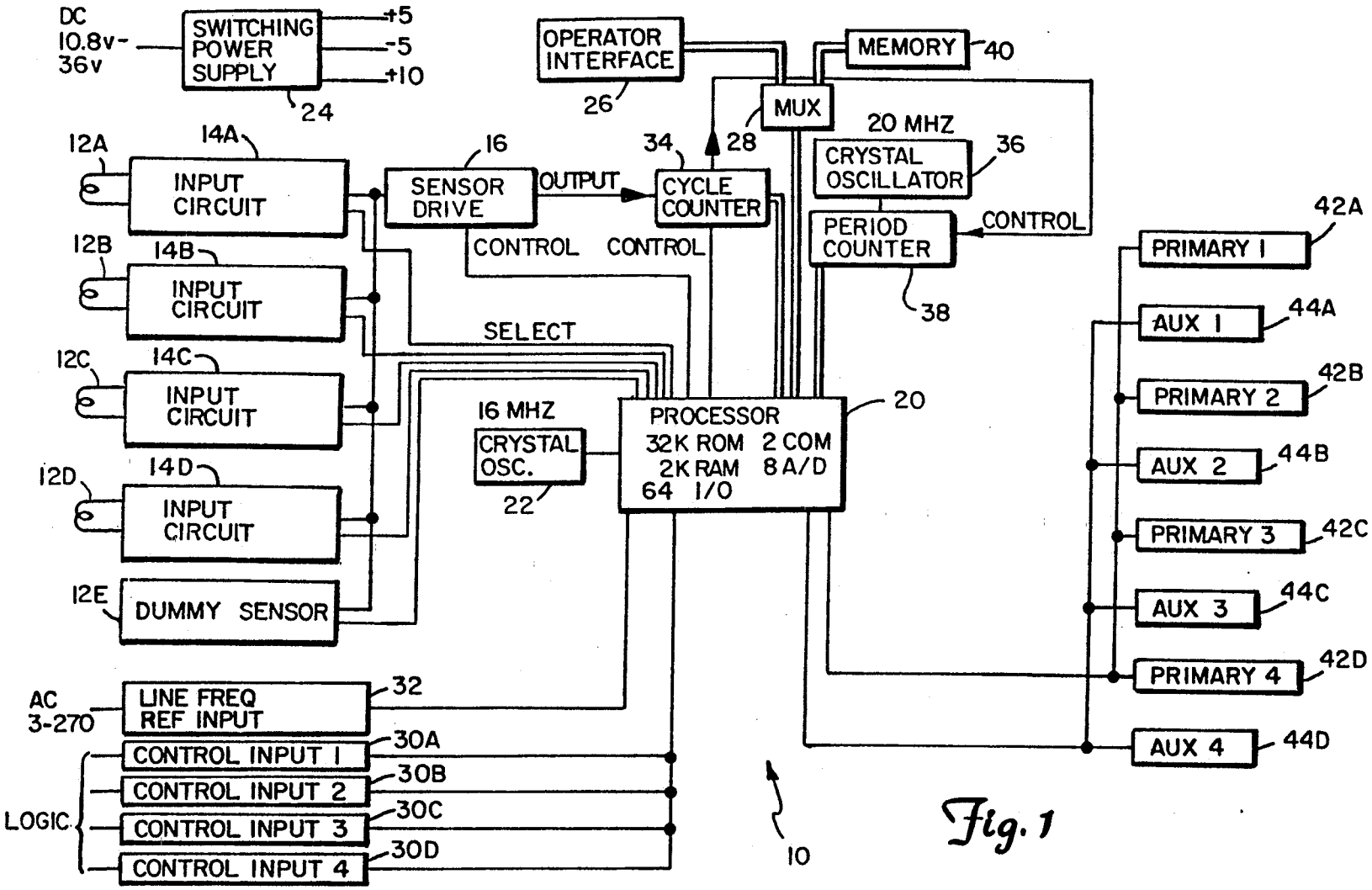
FIG. 1 is a block diagram of a vehicle loop detector which makes use of the measurement frame segmentation method.

Vehicle detector 10 shown in FIG. 1 is a four channel system which monitors the inductance of inductive sensors 12A, 12B, 12C and 12D. Each inductive sensor 12A–12D is connected to an input circuit 14A–14D, respectively. Sensor drive oscillator 16 is selectively connected through input circuits 14A–14D to one of the inductive sensors 12A–12D to provide a drive current to one of the inductive sensors 12A–12D. The particular inductive sensor 12A–12D which is connected to oscillator 16 is based upon which input circuit 14A–14D receives a sensor select signal from digital processor 20. Sensor drive oscillator 16 produces an oscillator signal having a frequency which is a function of the inductance of the inductive sensors 12A–12D to which it is connected.

Also shown in FIG. 1, dummy sensor 12E is provided and is connected to sensor drive oscillator 16 in response to a select signal from digital processor 20. Dummy sensor 12E has an inductance which is unaffected by vehicles, and therefore provides a basis for adjustment or correction of the values measured by inductive sensors 12A–12D.

The overall operation of vehicle detector 10 is controlled by digital processor 20. Crystal oscillator 22 provides a high frequency clock signal for operation of digital processor 20. Power supply 24 provides the necessary voltage levels for operation of the digital and analog circuitry within the vehicle detector 10.

Digital processor 20 receives inputs from operator interface 26 (through multiplexer 28), and receives control inputs from control input circuits 30A–30D. In a preferred embodiment, control input circuits 30A–30D receive logic signals, and convert those logic signals into input signals for processor 20.

Processor 20 also receives a line frequency reference input signal from line frequency reference input circuit 32. This input signal aids processor 20 in compensating signals from inductive sensors 12A–12D for inductance fluctuations caused by nearby power lines.

Cycle counter 34, crystal oscillator 36, period counter 38, and processor 20 form detector circuitry for detecting the frequency of the oscillator signal. Counters 34 and 38 may be discrete counters (as illustrated in FIG. 1) or may be fully or partially incorporated into processor 20.

In a preferred embodiment of the present invention, digital processor 20 includes on-board read only memory (ROM) and random access memory (RAM) storage. In addition, non-volatile memory 40 stores additional data such as operator selected settings which are accessible to processor 20 through multiplexer 28.

Vehicle detector 10 has four output channels, one for each of the four sensors 12A–12D. The first output channel, which is associated with inductive sensor 12A, includes primary output circuit 42A and auxiliary output circuit 44A. Similarly, primary output circuit 42B and auxiliary output circuit 44B are associated with inductive sensor 12B and form the second output channel. The third output channel includes primary output circuit 42C and auxiliary output circuit 44C, which are associated with inductive sensor 12C. The fourth channel includes primary output circuit 42D and auxiliary output circuit 44D, which are associated with inductive sensor 12D.

Processor 20 controls the operation of primary output circuits 42A–42D, and also controls the operation of auxiliary output circuits 44A–44D. The primary output circuits 42A–42D provide an output which is conductive even when vehicle detector 10 has a power ( failure. The auxiliary output circuits 44A–44D, on the other hand, have outputs which are non-conductive when power to vehicle detector 10 is off.

In operation, processor 20 provides sensor select signals to input circuits 14A–14D to connect sensor drive oscillator 16 to inductive sensors 12A–12D in a time multiplexed fashion. Similarly, a sensor select signal to dummy sensor 12E causes it to be connected to sensor drive oscillator 16. Processor 20 also provides a control input to sensor drive oscillator 16 to select alternate capacitance values used to resonate with the inductive sensor 12A–12D or dummy sensor 12E. When processor 20 selects one of the input circuits 14A–14D or dummy sensor 12E, it also enables cycle counter 34. As sensor drive oscillator 16 is connected to an inductive load (e.g., input circuit 14A and sensor 12A) it begins to oscillate. The oscillator signal is supplied to cycle counter 34, which counts oscillator cycles. After a brief stabilization period for the oscillator signal to stabilize, processor 20 enables period counter 38, which counts in response to a very high frequency (e.g., 20 MHz) signal from crystal oscillator 36.

When cycle counter 34 reaches the predetermined number $N_{seg}$ of oscillator signal cycles after oscillator stabilization, it provides a control signal to period counter 38, which causes period counter 38 to stop counting. The count from period counter 38 is representative of the period of the oscillator signal over $N_{seg}$ cycles. The period of the oscillator signal is the inverse of the frequency. Frequency is inversely related to sensor inductance while the period of the oscillator signal is directly related to inductance. The count in periodic counter 38 of the end of the frame segment, therefore, is representative of measured inductance during the frame segment.

After the completion of each measurement frame segment, processor 20 produces a total measurement frame time duration representative of a predetermined number M of period counts. M can be the same or different for each respective sensor. The M period counts were taken during the current measurement frame segment and M minus one (e.g., three when M is equal to four) past measurement frame segments for that particular inductive sensor. In other words, the total measurement frame duration is representative of inductance of the inductive sensor, as measured over a plurality of individual frame segments.

Figure 2:
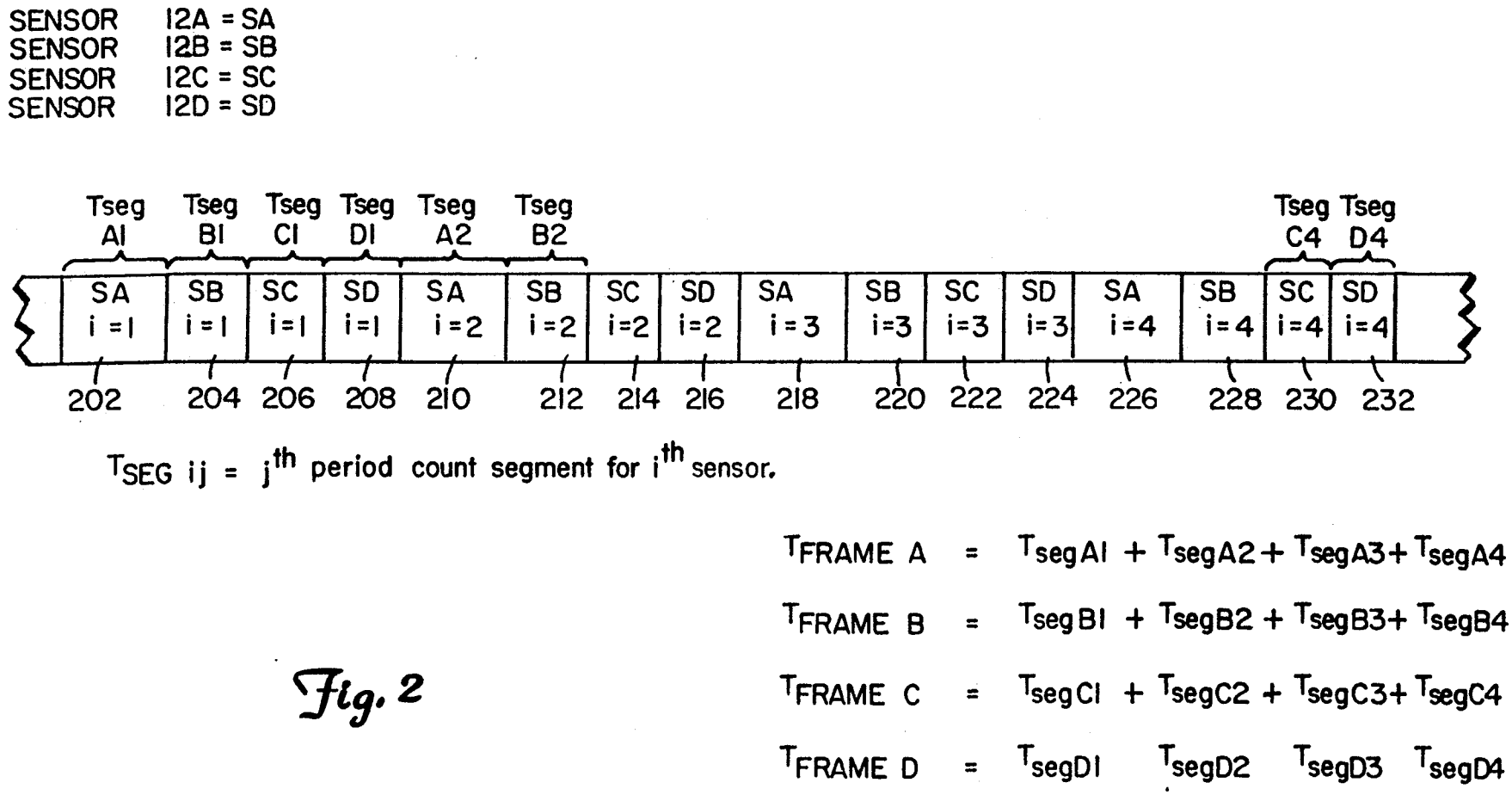
FIG. 2 is a diagram illustrating the measurement frame segmentation concept.

As illustrated in FIG. 2, M measurement frame segments together constitute a single measurement frame. As shown in this illustration, the detector measures the period count $T_{seg}$ for sensor 12A (FIG. 1) during a measurement frame segment 202. Next the period count of sensor 12B is measured during segment 204. Then the period count of sensors 12C and 12D are measured during segments 206 and 208, respectively. The detector repeats this sequential measurement pattern continuously through frame segments 210–232. Also as shown in FIG. 2, a complete measurement frame count or time duration $T_{framea}$ for sensor 12A is equivalent to the sum M (in this example, M=4) period counts or time durations measured during M measurement frame segments.

$$T_{FRAMEA}=T_{segA1}+T_{segA2}+T_{segA3}+T_{segA4}$$

where, $T_{FRAMEA}$=the total measurement frame count or time duration for sensor 12A

$T_{segAi}$=the period count or time duration $T_{seg}$ for sensor 12A measured during the $i^{th}$ measurement frame segment taken while oscillator 16 is connected to sensor 12A

The total measurement frame counts $T_{FRAMEB}$-$T_{FRAMED}$ for sensors 12B–12D are calculated in the same manner.

Processor 20 compares the total measurement calculated with no vehicle near the inductive sensor, and a difference is calculated. A change in the count which exceeds a predetermined threshold, $\Delta T_{Thresh}$, indicates the presence of a vehicle near inductive sensor 12A, and processor 20 provides the appropriate signals to primary and auxiliary output circuits 42A and 44A to signal presence of a vehicle.

Because change in count is representative of change in the period of oscillator signal from sensor drive oscillator 16, the following equations may be used to define the operation of the present invention.

A change in oscillator period $\Delta T$, caused by the presence of a vehicle is equal to the measured oscillator period ($T_{FRAME}$) minus the reference oscillator period $T_{REF}$.

$$\Delta T = T_{FRAME} - T_{REF}$$

The threshold change in oscillator period $\Delta T_{Thresh}$, needed before a call is generated is typically set to the integer value of 16 counts. Under normal use, with no vehicle present it would take $N_{meas}$ cycles of the oscillator signal to establish the reference count needed to establish $T_{REF}$, and thus constitute one measurement frame.

$$N_{meas} = N_{seg} * M$$

where, $N_{seg}$=the number of oscillator cycles in one frame segment;

M=the number of frame segments in one measurement frame.

If however, other than $N_{meas}$ counts are used, then $\Delta T_{Thresh}$ must be integerized using the following formula:

$$\Delta T_{Thresh1} = 16 * T_{cry} * \frac{N_{MACT}}{N_{meas}}$$

where,

16=The number of cycles of crystal oscillator 36 defined as the threshold;

$T_{cry}$=The period of crystal oscillator 36;

$N_{MACT}$=The number of sensor drive oscillator cycles actually used to constitute a measurement frame.

One method of calculating a total measurement frame change in period, for a particular sensor, after each frame segment is shown in the following formula:

For i=1 to M $$T_{FRAME} = \left(\sum_{1}^{i} T_{segi}\right) + \left(T_{lastnmeas} * \frac{M-i}{M}\right)$$

where, $T_{FRAME}$=Total measurement frame period;

$T_{segi}$=Measurement frame segment count that has been completed for a particular sensor during the $i^{th}$ measurement frame;

$T_{lastnmeas}$=The total measurement frame measured during the last full measurement frame;

M=The total number of measurement frame segments, taken while monitoring a particular sensor, in one measurement frame.

In the above formula, as the number of completed measurement frame segments i increases, less of the last measurement frame period $T_{lastnmeas}$ is used. The detector Will determine that a vehicle has been detected and makes a call if $\Delta T = T_{FRAME} - T_{REF}$ is greater than $\Delta T_{Thresh}$. A call will later be cancelled if a subsequent $\Delta T$ is less than a quarter of $\Delta T_{Thresh}$. Although another value could be chosen, we have found $\frac{1}{2}\Delta T_{Thresh}$ to be better than, for example, $\frac{1}{4}\Delta T_{Thresh}$.

If $\Delta T > \Delta T_{Thresh}$, then a call is made.

If a subsequent $\Delta T < \Delta T_{Thresh} \div 4$, then cancel.

Other methods of calculating $T_{FRAME}$ are also within the scope of the invention. For example, if processor 20 always stores the last M-1 values of $T_{seg}$ for each sensor, then $T_{FRAME}$ can be calculated simply by summing the just completed value of $T_{seg}$ with the stored values. In this embodiment, $T_{FRAME}$ is a rolling average of the M most recent frame segments. The particular method used to calculate $T_{FRAME}$ depends on considerations such as calculating time and memory requirements.

The advantage of making a vehicle detection decision for a particular sensor after each measurement frame segment taken while monitoring that sensor, as opposed to prior art systems which made a decision only after an entire measurement frame (e.g., after $M*N_{seg}$ oscillator cycles had been counted), is that large vehicles may be detected after a single frame segment, while smaller vehicles will still be detected by a composite of a sufficient number of frame segments. This measurement frame segmentation method provides increased measurement speed for large vehicles, while maintaining detector sensitivity sufficient to detect small inductance changes.

The measurement frame segmentation method will increase measurement speed for small vehicles as well. Response time for small vehicles is enhanced because of the repeated calculation of total measurement frame time durations. In a prior art system, if during one long measurement frame the inductance changed, but did not quite change enough for a small vehicle to be detected, another full long measurement frame would have to be completed before the small vehicle would be detected. Calculating a total measurement frame time duration after each short measurement frame segment, allows the small vehicle to be detected after the next short frame segment measurement period. Therefore, response time is improved for the detection of vehicles of all sizes.

An important aspect of the invention is its use of two independent high frequency oscillators 22 and 36, one for control purposes (oscillator 22) and one for measurement purposes (oscillator 36), to eliminate the effects of digitization noise. When measuring the resonant frequency of an oscillator by counting the number of cycles of a high frequency clock during an integer number of oscillator cycles, the resultant count for a stable resonant oscillator frequency during successive repeated measurement periods will have an error between zero and two. This error, referred to as digitization noise, occurs because minute frequency changes can cause the observation of an extra clock edge or can cause a clock edge to be missed. To avoid false vehicle detection calls due to digitization error, a threshold count of four or more is typically used.

Figure 3:
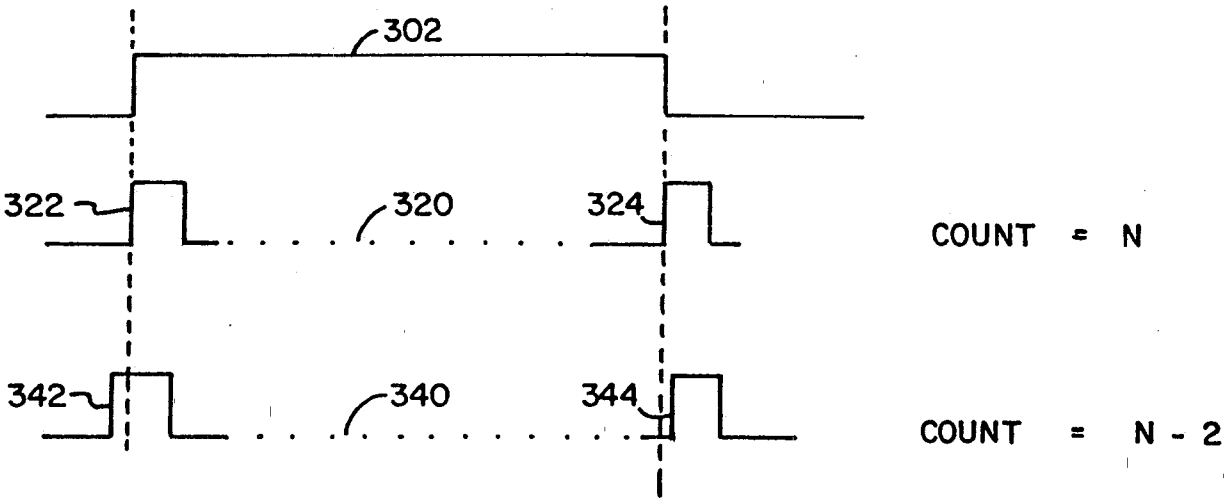
FIG. 3 is a timing diagram illustrating the effects of digitization noise and the need for randomization.

FIG. 3 illustrates the cause of digitization noise. In FIG. 3, a measurement frame segment period comprised of $N_{seg}$ oscillator 16 cycles is shown as a pulse 302. During pulse 302, the cycle counter counts $T_{seg}$ cycles of a high frequency clock signal. The count is illustrated by digital waveforms 320 and 340. In waveform 320, rising edges 322 and 324 of the high frequency clock occur during pulse 302 and are counted, resulting in an error of zero pulses being missed. In waveform 340, with a slightly different frequency, rising edges 342 and 344 are not counted because they occur slightly outside of pulse 302. The missing of two clock pulses causes a very slight frequency change to appear much larger.

Digitization noise averages to zero, even in the short term, if the phase of the high frequency clock is random with respect to zero crossings of the signal from oscillator 16 for successive measurement periods. The phase will not be random if the same high frequency clock that starts oscillator 16 is counted during the resonant frequency measurement. The present invention, as illustrated in FIG. 1, uses two high frequency oscillators 22 and 36, one for control purposes (oscillator 22) and an independent one for measurement purposes (oscillator 36). To maintain randomization, the control oscillator 22 must start and stop oscillator 16 between successive measurement frame segments on the same inductive sensor 12A–12D.

Once the digitization noise is randomized, it will sum to zero, and the long measurement frame required for small inductance changes may be split into multiple shorter measurement frame segments. Large inductance changes may be determined at the end of each short measurement frame segment. Small inductance changes may be determined by summing the results of the multiple shorter measurement frame segments that would equal the longer measurement frame (e.g., $M*N_{seg}$ oscillator cycles) required to detect for the small inductance change. Because the measurement frame segmentation method can magnify non-random digitization error, prior art systems which used one crystal oscillator for all high frequency purposes would be unable to utilize the method.

Although the present invention has been described with reference to preferred embodiments, workers skilled in the art will recognize that changes may be made in form and detail without departing from the spirit and scope of the invention.

What is claimed is:

1. An apparatus for detecting the presence of an object with an inductive sensor, the apparatus comprising:

an oscillator circuit for connection to the inductive sensor, the oscillator circuit producing an oscillator signal having a frequency which is a function of inductance of the inductive sensor;

timing means for measuring the duration of each of a plurality of measurement frame segments during which the oscillator circuit is connected to the inductive sensor, and in which each measurement frame segment is defined by a first number $N_{seg}$ of cycles of the oscillator signal, where $N_{seg}$ is an integer;

means for producing, after the completion of each measurement frame segment, a total measurement frame duration which is dependent upon the duration of the most recent measurement frame segments and the durations of a predetermined number M of past measurement frame segments, where M is an integer which is greater than one;

reference means for defining a reference time duration; means for comparing the total measurement frame time duration and the reference time duration for determining the difference therebetween; and threshold means responsive to the difference between the total measurement frame time duration and the reference time duration for generating a signal indicative of presence of a said object in the vicinity of the inductive sensor when the difference exceeds a threshold value.

2. An apparatus adapted for used with a plurality of inductive sensors, each supported adjacent a different area of a roadway surface for detecting the presence of a vehicle on any of the areas, the apparatus comprising:

an oscillator circuit producing an oscillator signal having a frequency which is a function of inductance; means coupled to the oscillator circuit for defining a plurality of sequential measurement frames, each frame in turn being defined by a plurality of sequential frame segments, each frame segment containing a defined, predetermined number $N_{seg}$ of cycles of said frequency of the oscillator circuit wherein $N_{seg}$ is an integer;

switching means for coupling the oscillator circuit to a different inductive sensor during difference frame segments, the oscillator circuit oscillating at a said frequency which is a function of inductance of the inductive sensor to which it is connected;

period measurement means for measuring a period of each of the frame segments;

storage means for storing a reference value for each inductive sensor, the reference value being representative of a reference period for a total measurement frame formed by a plurality of frame segments produced with the same inductive sensor;

means for deriving a total measurement frame period from the period of frame segment just completed and the periods of a predetermined number of previous frame segments produced with the same inductive sensor; and means for comparing a relative magnitude of the total measurement frame period for one of the inductive sensors with the reference value corresponding to that inductive sensor, thereby indicating the presence of the vehicle at one of the said areas.

3. A method of vehicle detection comprising:

(a) connecting an oscillator circuit to a first inductive sensor to produce an oscillator signal having a frequency which is a function of inductance of the inductive sensor;

(b) counting $N_{seg}$ cycles of the oscillator signal with a cycle counter, where $N_{seg}$ is a predetermined integer;

(c) counting the cycles of an independent high frequency clock with a period counter;

(d) stopping the period counter when the cycle counter has finished counting $N_{seg}$ cycles of the oscillator signal, the period counter containing a period count which is a function of the inductance of the inductive sensor;

(e) calculating a measurement frame value for the first inductive sensor based upon the period count just completed and a predetermined number of period counts previously produced when the oscillator was connected to the first inductive sensor;

(f) comparing the measurement frame value to a reference value and determining a difference; and (g) generating a signal indicative of the presence of a vehicle in the vicinity of the first inductive sensor when the difference between the measurement frame value and the reference value exceeds a threshold value.

4. The method of claim 3 wherein steps (a)–(g) storing data previously used in calculating the measurement frame value according to step (e) for use in calculating future measurement frame values;

5. The method of claim 3 wherein steps (a)–(g) are repeated for each of a plurality of inductive sensors.

6. An apparatus for detecting the presence of a vehicle with an inductive sensor, the apparatus comprising:

an oscillator circuit for connection to the inductive sensor, the oscillator circuit producing an oscillator signal having a frequency which is a function of inductance of the inductive sensor;

first digital counter means for counting the number of cycles of the oscillator signal occurring while the oscillator circuit being is connected to the inductive sensor and during each of a plurality of measurement frame segments, wherein each said segment is defined by a first number $N_{seg}$ of cycles of the oscillator signal, where $N_{seg}$ is an integer;

second digital counter means for measuring the duration of each measurement frame segment by counting the number of cycles of a separate and independent clock signal having a frequency much higher than the oscillator signal during the time in which the first digital counter counts $N_{seg}$ cycles of the oscillator signal;

means for producing, after the completion of each measurement frame segment, a total measurement frame duration value for a particular inductive sensor which is dependent upon the duration of the most recent measurement frame segment and the durations of a predetermined number M of past measurement frame segments from that inductive sensor, where M is an integer which is greater than one;

reference means for defining a reference time duration value;

means for comparing determining the total measurement frame time duration value and the reference time duration value and for determining the difference therebetween; and threshold means responsive to the difference between the total measurement frame duration value and the reference time duration value for generating a signal indicative of the presence of a vehicle in the vicinity of the inductive sensor when the difference exceeds a threshold value.

7. The apparatus of claim 6 and further comprising:

means for coupling the oscillator circuit to a different inductive sensor during a different plurality of measurement frame segments, the oscillator circuit oscillating at a frequency during each frame segment which is a function of inductance of the inductive sensor to which it is connected during that frame segment.

8. The apparatus of claim 6 and further comprising:

means for stopping the oscillator circuit between successive frame segments.

9. A method of detecting presence of an object with an inductive sensor, the method comprising:

measuring the duration of each of a plurality of measurement frame segments during which the inductive sensor is connected in an oscillator circuit and in which each measurement frame segment is defined by a first number $N_{seg}$ of cycles of the oscillator signal generated by the oscillator circuit, where $N_{seg}$ is an integer;

deriving a total measurement frame duration after completion of each frame segment based upon the durations of a predetermined number M of preceding measurement frame segments, where M is an integer greater than one;

comparing the total measurement frame duration measurement value to a reference duration; and providing an output signal indicative of presence of the object when the difference exceeds a threshold value.

10. The method of claim 9 and further comprising:

stopping the oscillator circuit between successive frame segments.

* * * * *